US009305760B2

(12) United States Patent
Barofsky et al.

(10) Patent No.: US 9,305,760 B2
(45) Date of Patent: Apr. 5, 2016

(54) ELECTRON SOURCE FOR AN RF-FREE ELECTRONMAGNETOSTATIC ELECTRON-INDUCED DISSOCIATION CELL AND USE IN A TANDEM MASS SPECTROMETER

(71) Applicant: State of Oregon acting by and through the State board of higher education on behalf of OSU, Corvallis, OR (US)

(72) Inventors: Douglas F. Barofsky, Bend, OR (US); Valery G. Voinov, Corvallis, OR (US); Joseph S. Beckman, Corvallis, OR (US)

(73) Assignee: STATE OF OREGON ACTING BY AND THROUGH THE STATE BOARD OF HIGHER EDUCATION ON BEHALF OF OREGON STATE UNIVERSITY, Corvallis, OR (US)

( * ) Notice: Subject to any disclaimer, the term of this patent is extended or adjusted under 35 U.S.C. 154(b) by 0 days.

(21) Appl. No.: 14/420,545

(22) PCT Filed: Aug. 15, 2013

(86) PCT No.: PCT/US2013/055067

§ 371 (c)(1),
(2) Date: Feb. 9, 2015

(87) PCT Pub. No.: WO2014/028695

PCT Pub. Date: Feb. 20, 2014

(65) Prior Publication Data

US 2015/0187557 A1 Jul. 2, 2015

Related U.S. Application Data

(60) Provisional application No. 61/683,995, filed on Aug. 16, 2012.

(51) Int. Cl.
*H01J 49/40* (2006.01)
*H01J 49/14* (2006.01)
(Continued)

(52) U.S. Cl.
CPC ..... *H01J 49/147* (2013.01); *H01J 49/08* (2013.01); *H01J 49/26* (2013.01)

(58) Field of Classification Search
USPC ..... 250/281, 282, 283, 286, 287
See application file for complete search history.

(56) References Cited

U.S. PATENT DOCUMENTS 2,457,530 A 12/1948 Coggeshall
3,842,269 A 10/1974 Liebl
(Continued)

FOREIGN PATENT DOCUMENTS

JP 2006185781 A 7/2006
JP 2010170754 8/2010

OTHER PUBLICATIONS

Extended European Search Report (EESR) dated Jul. 13, 2015 in correspondence EP Application No. 09767393.3.
(Continued)

*Primary Examiner* — Nicole Ippolito
(74) *Attorney, Agent, or Firm* — Niels Haun; Dann, Dorfman, Herrell & Skillman, PC

(57) ABSTRACT

An electron source for electron-induced dissociation in an RF-free electromagnetostatic cell for use installation in a tandem mass spectrometer is provided. An electromagnetostatic electron-induced dissociation cell may include at least one magnet having an opening disposed therein and having a longitudinal axis extending through the opening, the magnet having magnetic flux lines associated therewith, and an electron emitter having an electron emissive surface comprising a sheet, the emitter disposed about the axis at a location relative to the magnet where the electron emissive surface is substantially perpendicular to the magnetic flux lines at the electron emissive surface.

20 Claims, 17 Drawing Sheets

(51) Int. Cl.
*H01J 49/08* (2006.01)
*H01J 49/26* (2006.01)

(56) References Cited

U.S. PATENT DOCUMENTS

| | | | | |
|---|---|---|---|---|
| 3,969,644 | A | 7/1976 | Nowak | |
| 4,578,663 | A | 3/1986 | Sanders | |
| 4,731,598 | A | 3/1988 | Clarke | |
| 4,949,043 | A | 8/1990 | Hillenbrand | |
| 5,014,028 | A | 5/1991 | Leupold | |
| 5,091,645 | A | 2/1992 | Elliott | |
| 5,563,415 | A | 10/1996 | Crewe | |
| 6,541,781 | B1 | 4/2003 | Benveniste | |
| 6,590,206 | B1 | 7/2003 | Evrard | |
| 6,891,157 | B2 | 5/2005 | Bateman | |
| 6,989,533 | B2 | 1/2006 | Bellec | |
| 7,116,051 | B2 | 10/2006 | Vancil | |
| 7,148,778 | B2 | 12/2006 | Humphries | |
| 7,164,139 | B1 | 1/2007 | Toth | |
| 7,227,133 | B2 | 6/2007 | Glish | |
| 7,326,350 | B2 | 2/2008 | Mueller | |
| 7,381,946 | B2 | 6/2008 | Baba | |
| 7,397,025 | B2 | 7/2008 | Baba | |
| 7,498,572 | B2 | 3/2009 | Fujita | |
| 7,535,329 | B2 | 5/2009 | Gorshkov | |
| 7,573,029 | B2 | 8/2009 | Heninger | |
| 7,589,321 | B2 | 9/2009 | Hashimoto | |
| 7,612,335 | B2 | 11/2009 | Makarov | |
| 7,635,850 | B2 | 12/2009 | Yamashita | |
| 7,655,922 | B2 | 2/2010 | Smatlak | |
| 7,807,965 | B2 | 10/2010 | Zach | |
| 8,723,113 | B2 | 5/2014 | Barofsky | |
| 2004/0245448 | A1 | 12/2004 | Glish | |
| 2004/0245488 | A1 | 12/2004 | Isbitsky | |
| 2005/0017165 | A1 | 1/2005 | Franzen | |
| 2005/0178955 | A1* | 8/2005 | Baba et al. | 250/281 |
| 2005/0258354 | A1 | 11/2005 | Baba | |
| 2006/0169892 | A1 | 8/2006 | Baba | |
| 2006/0232368 | A1 | 10/2006 | Gorshkov | |
| 2007/0023648 | A1 | 2/2007 | Baba | |
| 2007/0069124 | A1 | 3/2007 | Baba | |
| 2007/0138386 | A1 | 6/2007 | Makarov | |
| 2007/0194251 | A1 | 8/2007 | Ward | |
| 2008/0135775 | A1 | 6/2008 | Smatlak | |
| 2009/0101818 | A1 | 4/2009 | Zach | |
| 2010/0209335 | A1* | 8/2010 | Mills | 423/648.1 |
| 2010/0237237 | A1 | 9/2010 | Green | |
| 2011/0049347 | A1 | 3/2011 | Wells | |
| 2011/0233397 | A1* | 9/2011 | Barofsky et al. | 250/294 |
| 2012/0193533 | A1 | 8/2012 | Zach | |

OTHER PUBLICATIONS

2. Valery G. Voinov et al.: "Radio-Frequency-Free Cell for Electron Capture Dissociation in Tandem Mass Spectrometry", Analytical Chemistry,vol. 81, No. 3, Feb. 1, 2009, pp. 1238-1243, XP055190702, ISSN: 0003-2700.

'ECD in a Linear RF-Field without Buffer Gas.' 55th ASMS Conference on Mass Spectrometry and Allied Topics, Indianapolis, Indiana: 1381 (WPE-084) poster presentation from the 55th ASMS Conference in Indianapolis, Jun. 3-7, 2007.

Baba, T., et al., 'Electron Capture Dissociation in a Radio Frequency Ion Trap', Analytical Chemistry, vol. 76, No. 15, Aug. 1, 2004, pp. 4263-4266.

Baba, T., et al., Electron Capture Dissociation in a Tiny Penning Trap Coupled With a Linear Radio-Frequency-Quadrupole Ion Trap—Time-of-Flight—Mass Spectrometer, 2 pages, ASMS Conference, Montreal, 2003.

Baba, Takashi, et al., 'Electron-Caputre Dissociation in a Radio-Frequency Linear Ion Trap', Spectroscopy, Jul. 1, 2007.

Baba, Takeashi, et al, "High Throughout ECD in a RF Ion Trap", TP12-238, 53rd ASMS 2005, Poster.

Baba, T., et al., "Electron Capture Dissociation in a Radio-Frequency Linear Ion Trap," Nov. 2007.

Bushey, Jared M., et al., 'Simultaneous Collision Induced Dissociation of the Charge Reduced Parent Ion during Electron Capture Dissociation', Anal. Chem. 2009, 81, 6156-6164.

Cambpell, P., "Permanent Magnet Materials and Their Application", Cambridge University Press, Cambridge: 1994, pp. 201-202.

Cody, R.B., et al., 'Electron Impact Excitation of Ions from Organics an Alternative to Collision Induced Dissociation', Analytical Chemistry, vol. 51, No. 4, Apr. 1979, 547-551.

Dahl, P., "Introduction to Electron and Ion Optics", Academic Press: New York, 1973, pp. 42-72.

Ding, L., et al., 'Electron Capture Dissociation in a Digital Ion Trap Mass Spectrometer', Analytical Chemistry, vol. 78, No. 6, Mar. 15, 2006, pp. 1995-2000.

Downard, K.M., "Mass Spectrometry a Foundation Course", The Royal Society of Chemistry: Cambridge, 2004, pp. 22-83.

Gross, J.H., "Mass Spectrometry a Textbook", Springer: New York, 2004, pp. 1-12 and 488-494.

Kjeldsen, F., et al., 'Dissociative Capture of Hot (3-13 eV) Electrons by Polypeptide Polycations: An Efficient Process Accompanied by Secondary Fragmentation', Chemical Physics Letters, vol. 356, Apr. 22, 2002, 201-206.

McCaig, M., 'Permanent Magnets in Theory and Practice', John Wiley and Sons: NY, 1977, pp. 298-303.

Moskowitz, L.R., "Permanent Magnet Design and Application Handbook", Cahners Books International: Boston, 1976, pp. 89-92.

Satake, Hiroyuki, et al., 'Fast Multiple Electron Capture Dissociation in a Linear Radio Frequency Quadrupole Ion Trap', Anal. Chem. 2007, 79, 8755-8761.

Schwartz, J., et al., 'A Two-Dimensional Quadrupole Ion Trap Mass Spectrometer', J. Am. Soc. Mass Spectrom 2002, 13, pp. 659-669.

Silivra, O., et al., 'Electron Capture Dissociation of Polypeptides in a Three-Dimensional Quadrupole Ion Trap: Implementation and First Results', J. Am. Soc. Mass Spectrom 2005, 16, pp. 22-27.

Syka, J., et al., 'Peptide and protein sequence analysis by electron transfer dissociation mass spectrometry', PNAS, Jun. 29, 2004, vol. 101, No. 26, pp. 9528-9533.

Voinov, V.G., et al., "Electron Capture Dissociation in a Linear Radiofrequency-Free Magnetic Cell", RCM Letter to the Editor, Rapid Communications in Mass Spectrometry, 2008; 22: 3087-3088.

Yuichiro, Hashimoto, et al., Tandem Mass Spectrometry Using an Axially Resonant Excitation Linear Ion Trap, J. Mass Spectrom. Soc. Jpn., vol. 55, No. 5, 2007.

Zubarev, R., 'Electron-capture dissociation tandem mass spectrometry', Current Opinion in Biotechnology, 2004, 15:12-16.

Zubarev, Roman A., "Reactions of Polypeptide Ions with Electrons in the Gas Phase", Mass Spectrometry Reviews, 2003, 22, 57-77.

* cited by examiner

ELECTRON SOURCE FOR AN RF-FREE ELECTRONMAGNETOSTATIC ELECTRON-INDUCED DISSOCIATION CELL AND USE IN A TANDEM MASS SPECTROMETER

RELATED APPLICATIONS

This application is a 371 application of International Application No. PCT/US2013/55067 filed Aug. 15, 2013, which claims the benefit of priority of U.S. Provisional Patent Application No. 61/683,995 filed Aug. 16, 2012. Each of the foregoing applications is hereby incorporated herein by reference.

GOVERNMENT LICENSE RIGHTS

This invention was made with government support under Grant No. CHE0924027 awarded by the National Science Foundation, by Grant No. RO1 RR026275-02 awarded by the National Institutes of Health, and by Grant No. E500210 awarded by the National Institute of Environmental Health Science. The government has certain rights in the invention.

FIELD OF THE INVENTION

The present invention relates generally to radio-frequency-free hybrid electrostatic/magnetostatic cells and methods for dissociating ions in mass spectrometers, and more particularly, but not exclusively, to internal electron source configurations for use with such cells and methods.

BACKGROUND OF THE INVENTION

Academic and commercial instrument designers alike have come to over rely on strictly electrostatically- and RF-driven devices for dissociating ions in tandem mass spectrometers, roughly half of which are analyzer-dependent. From a manufacturing point of view, this situation stifles development of new instrumentation, software, and methodology; from a research point of view, it shackles the design and execution of experiments or limits their informational output.

By way of review, there is a family of processes whereby ions can be induced to dissociate (fragment) by interacting with free electrons. These processes, which by various mechanisms force transitions in the precursor ions from bonding energy states to antibonding energy states, are loosely defined by the energy regimes from which the reactant electrons are drawn. In electron-capture dissociation (ECD), free electrons having energies on the order of 1 eV are used to break N—$C_\alpha$ backbone-bonds in multiply protonated (cationic) peptides. [Zubarev R.A. (2003). Reactions of polypeptide ions with electrons in the gas phase. *Mass Spectrometry Reviews* 22, 57-77.] The term hot ECD is used when ECD experiments are conducted with electrons ranging in energy from 3 to 13 eV. [Kjeldsen F., Haselmann K.F., Budnik B.A., Jensen F., and Zubarev R.A. (2002). Dissociative capture of hot (3-13 eV) electrons by polypeptide polycations: an efficient process accompanied by secondary fragmentation. *Chemical Physics Letters* 356, 201-206.; Zubarev, 2003]. Electron impact excitation of ions from organics (EIEIO) results from inelastic collisions with electrons ranging in energy from 10 to 20 eV. [Cody R.B. and Freiser B.S. (1979). Electron impact excitation of ions from organics: an alternative to collision induced dissociation. *Analytical Chemistry* 51, 547-551.] In electron ionization dissociation (EID), cations interact with fast electrons having energies at least 10 eV higher than the ionization threshold of the cations. [Fung, Y.M., Adams, C.M., and Zubarev, R.A. (2009). Electron ionization dissociation of singly and multiply charged peptides. *Journal of the American Chemical Society* 131, 9977-9985.] In electron-detachment dissociation (EDD, which is the negative-ion counterpart to ECD) [Zubarev, 2003], electrons having energies on the order of 20 eV create positive-radicals or holes in peptidic anions that induce inter-residue bonds in the latter to break. All of these electron-induced dissociation processes, by whatever name has been given them, require that the precursor ions be forced to mingle with a dense population of electrons.

Under current practice with FT ICR (Fourier transform ion cyclotron resonance) mass spectrometers and other radio frequency (RF) devices [e.g., Satake H, Hasegawa H, Hirabayashi A, Hashimoto Y, Baba T. (2007). Fast multiple electron capture dissociation in a linear radio frequency quadrupole ion trap. Analytical Chemistry 79, 8755-8761.], the efficiencies of electron-induced fragmentation processes are fundamentally limited; electrons cannot be trapped at all in linear RF-based devices and only in small numbers in three-dimensional RF-traps (e.g., FT ICR cells). Consequently, there is no practicable way for increasing the density of electrons in reaction cells of these types. This is a major disadvantage for two practical reasons. First the charged-particle capacity of an RF-based device is relatively small; consequently, it is difficult to achieve high yields of product-ions from electron-induced dissociation reactions, which require that a reactant's density (i.e., the number of particles per unit volume) be as high as possible. Second, in terms of detection limit, resolution, and mass accuracy in analyses of organic compounds, FT ICR mass spectrometers are arguably the most powerful in existence; unfortunately, they are also the most expensive to purchase, difficult and expensive to operate and maintain, and ill-suited to the high throughput analyses frequently encountered in proteomics. Although electron-induced dissociation of peptides and proteins was discovered on an FT ICR instrument, the conditions for such reactions are just minimally met in the FT ICR cell. This is because the elementary physics of a collision between an electron and a molecular ion dictates that the energy necessary for any given electron-induced dissociation reaction be supplied almost entirely by the electron. Therefore, the design of any practical electron-induced dissociation cell should include a means for controlling both the average energy of the electrons and the width of the distribution about this average. This, however, is fundamentally impossible to accomplish in an FT ICR cell, and because of fundamental constraints on the latter's geometry and operation, the prospects for improving this circumstance are poor. Moreover, ECD based on FT ICR mass spectrometers became a practicable technique only after hollow dispenser (indirectly heated) cathodes were implemented in the ICR cell. Use of these cathodes solved two problems at once—the bigger emitting area provided better spatial overlapping between electrons and ions, and the higher electron yield increased the number of electron capture events. However, dispenser cathodes cannot tolerate vacuum pressures higher than $10^{-7}$ Torr. In an FT ICR mass spectrometer, the dispenser cathode is situated outside of the ICR cell, which is a region of very low pressure.

In principle, a large number of electrons can be trapped in a hybrid electromagnetostatic (EMS) cell. There are, however, technical obstacles that must be overcome in order for these electrons to occupy the same volume as the ions with which the electrons must react. (See Voinov V G, Deinzer M L, Barofsky D F. *Rapid Commun. Mass Spectrom.* 2008; 22: 3087; Voinov V G, Deinzer M L, Barofsky D F. *Anal. Chem.*

2009; 81: 1238; Voinov V G, Deinzer M L, Beckman J S, Barofsky D F. *J. AM Soc. Mass Spectrom.* 2011, 22, 607; and, Voinov V G, Beckman J S, Deinzer M L, Barofsky D F. *Rapid Commun. Mass Spectrom.* 2009, 23, 3028.) Accordingly, a need remains for devices and methods for dissociating ions in mass spectrometers that are not restricted by such limitations.

SUMMARY OF THE INVENTION

In one of its aspects, the present invention introduces a paradigm for designing and creating a family of heated filaments for producing electrons in electromagnetostatic (EMS) radio-frequency-free, mass analyzer-independent devices that can be incorporated into mass spectrometers for purposes, such as a) inducing ions to dissociate (i.e., fragment), b) collisionally cooling ions, c) separating ions on the basis of ion-mobility, or d) carrying out chemistry between ions and ions, ions and atoms, or ions and molecules in the gas-phase. In another of its aspects, the present invention discloses principles for locating sources of low-energy electrons in the cavity or at one or more positions outside of an EMS cell that will result in analytically useful product-ion yields from electron-induced dissociation reactions, by whatever name they have been given, in times on the order of or less than 1 μs—a feat that heretofore has been impossible to attain in RF-based and digital-based cells. This advance in the field provided by the present invention holds the promise to promote the development of new mass spectrometric systems and methodologies that will, in turn, make it possible to obtain much more information from studies of the energetics and kinetics of electron-induced dissociation reactions as well as from tandem mass spectrometric analyses of proteins and peptides. More specifically, the present invention relates to electron-induced dissociation processes such as electron-capture dissociation (ECD), hot ECD, electron impact excitation of ions from organics (EIEIO), electron ionization dissociation (EID), and electron-detachment dissociation (EDD). These dissociation processes are particularly suitable for analyzing peptides having at least 10-12 amino acids and for determining the sites and nature of labile post-translational modifications (PTMs) to peptides.

In particular, in one of its aspects the present disclosure describes central principles for designing embodiments of electron sources that can substantially increase the overlap between the volumes occupied by electrons and a beam of ions and, thereby, increase the reaction efficiencies of any electron-induced dissociation reaction. In this regard, the present invention provides important advances over the inventors' prior work as disclosed in the Published U.S. patent application No. 2011/0233397, which is incorporated herein by reference in its entirety. In particular, the present disclosure describes how the cavities of EMS cells might preferably be designed to efficiently trap electrons produced from internal sources or external sources, as well as how such sources might preferably be shaped and placed in order to increase the reaction efficiencies of any electron-induced dissociation process in the cell.

Based on the results of computer simulations, in accordance with the present invention two conditions may be met in order to create a high degree of overlap between the electron- and ion-volumes in an EMS electron-induced dissociation cell. Specifically, 1) the electrons should be emitted along (i.e., parallel to) the lines of magnetic flux density that intersect the surface of electron emission; and, 2) the electrons should be produced in or injected into a region of magnetic flux density whose lines of flux intersect the path the ion beam follows through the cell. When low energy electrons have components of velocity that are perpendicular to lines of magnetic flux density, magnetic forces are generated that cause the electrons to gyrate along the lines of magnetic flux wherever they might lead. If on the one hand those lines of magnetic flux do not pass through an ion-volume, the electrons trapped by them, no matter how abundant, will have no opportunity to be captured by ions. If on the other hand those lines of magnetic flux pass through a volume occupied by ions, the electrons trapped by them will have multiple opportunities to be captured by the ions in that volume. In the case of an EMS electron-induced dissociation cell therefore, only electrons (whether generated by an internal source in or transported from an external source into a region of magnetic flux density within the cell) captured by those lines of magnetic flux that intersect the ion beam passing through the cell along its optical axis can have any chance of being captured by the ions.

The first condition can be met innumerable ways, such as, by varying a) the shape and orientation of a source of electrons within or b) the direction through which electrons are injected into a region of magnetic flux density that meets the second condition. The second condition can be met innumerable ways by varying the shapes, sizes, polarizations (e.g., axial, radial, or multipolar), and linear or nonlinear arrangements (e.g., doublets, triplets, periodic multiplet array, or aperiodic multiplet array) of permanent magnets, electromagnets, or permanent magnets and electromagnets. Therefore, any electron source or sources used to meet the first condition within one or more segments of an EMS electron-induced dissociation cell in which one or more possible combinations of magnets are used to embody a region of magnetic flux density meeting the second condition falls within the purview of the present invention. As a result of new electron sources and EMS cell configurations presented herein, ECD has been achieved in linear, hybrid EMS cells at an efficiency of at least 2% without the aid of an RF field or a cooling gas. The cell's design and compact construction allow it to be incorporated into virtually any type of tandem mass spectrometer, e.g., triple quadrupole, hybrid quadrupole ion trap, hybrid quadrupole time-of-flight, or even FT-ICR. An ideal electron source would be one that, in addition to meeting the preceding two conditions, has a large emission area (and a correspondingly high electron yield), no voltage drop through the emitter, no magnetic field induced by the emitter itself, and a capability of operating at pressures on the order of $5\times10^{-5}$ Torr, which is typical for mass spectrometers with electrospray ionization (ESI) sources. A class of electron emitters known as dispenser cathodes possess all of the preceding characteristics except the one concerning pressure; they cease operating at pressures higher than $10^{-7}$ Torr. Dispenser cathodes mounted in EMS ECD cells installed in mass spectrometers that use ESI sources would be subject to the vacuum existing in these mass spectrometers, which is typically $2\text{-}6\times10^{-5}$ Torr, and would, therefore, render the cells inoperable. This would in turn defeat one goal of the present invention, viz. to make it possible to place an EMS ECD cell into virtually any existing type of mass spectrometer.

Accordingly, in one of its aspects the present invention provides an electromagnetostatic electron-induced dissociation cell, which may include at least one magnet having an opening disposed therein and having a longitudinal axis extending through the opening, the magnet having magnetic flux lines associated therewith. The cell may include an electron emitter having an electron emissive surface comprising a sheet and may be disposed about the axis at a location relative to the magnet where the electron emissive surface is substantially perpendicular to the magnetic flux lines at the electron emissive surface. The electron emissive surface may comprise a "sheet" of conducting material, for example a metal, a metal oxide, or a semiconductor. (As used herein a "sheet" of conducting material may comprise a cone, a dish of any curvature, a disc, a rectangle, a flat mesh of wires, a curved mesh of wires, a flat strip perforated with one or more holes, or a curved strip perforated with one or more holes, for example, which therefore excludes shapes such as a loop or a helical coil of wire, for instance.) The at least one magnet may include a first and a second magnet each having an opening disposed therein, and the first and second magnets may be disposed along a common longitudinal axis extending through the openings. The emitter may be disposed between the first and second magnets, or the first magnet may be disposed between the emitter and the second magnet. The electromagnetostatic electron-induced dissociation cell may also include a plurality of rods disposed in the opening of the at least one magnet and may include an AC source in electrical communication with the plurality of rods.

In another of its aspects the present invention provides an electromagnetostatic electron-induced dissociation cell which may include a plurality of magnets disposed proximate to one another defining a cavity therebetween having a longitudinal axis, the magnets having magnetic flux lines associated therewith. The cell may include an AC source in electrical communication with the plurality of magnets, and an electron emitter having an electron emissive surface. The emitter may be disposed about the axis at a location relative to the magnets where the electron emissive surface is substantially perpendicular to the magnetic flux lines at the electron emissive surface.

In further aspects, emitters of the present invention may include an opening disposed therein at a location on the axis, or may be otherwise configured, to permit the transmission of ions therethrough. In addition, the electron emissive surface may comprise a disc-shape, a cone-shape, a mesh, a sheet having a plurality of holes disposed therein, and/or a mesh of electron emissive wires, for example.

In a further aspect, the present invention may provide a mass spectrometer comprising any electromagnetostatic electron-induced dissociation cell in accordance with the present invention.

BRIEF DESCRIPTION OF THE DRAWINGS

The foregoing summary and the following detailed description of exemplary embodiments of the present invention may be further understood when read in conjunction with the appended drawings, in which:

FIG. 2A-2B schematically illustrate cross-sectional views of exemplary configurations of EMS electron-induced dissociation cells that meet the conditions for creating a high degree of overlap between the electron- and ion-volumes in cells in accordance with the present invention, in which: FIG. 2A schematically illustrates an EMS electron-induced dissociation cell in which a single-cone electron emitter is centrally located between two axially polarized permanent magnets, and FIG. 2B schematically illustrates an EMS electron-induced dissociation cell in which a flat-disc filament is located in a region of weak magnetic flux density produced by an electromagnet coupled to a strong, axially polarized, permanent magnet;

DETAILED DESCRIPTION OF THE INVENTION

Figure 1:
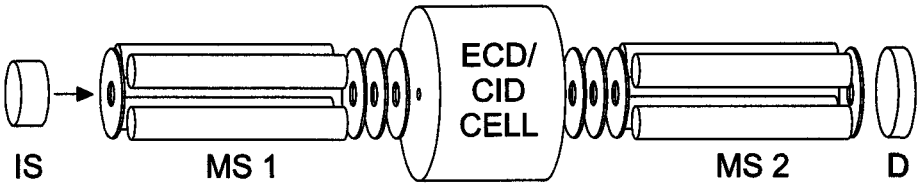
FIG. 1 schematically illustrates an exemplary quadrupole tandem mass spectrometer with an RF-free electromagnetostatic ECD Cell in accordance with the present invention.

In one of its aspects, the present invention relates to structures which may provide a source of electrons in an EMS electron-capture dissociation cell that may be incorporated in a tandem mass spectrometer, FIG. 1. In the example illustrated in FIG. 1, ions produced from a sample in the ionization source (IS) are guided through a first quadrupole (MS1) to select an ensemble of ions (the precursor ions) via the mass filtering action of RF electric forces. A fraction of the precursor ions are then fragmented in the ECD and/or CID (collision induced dissociation) cell, and the fragments produced in the ECD/CID Cell (the product ions) are guided through a second quadrupole (MS2) via the mass dispersing action of RF electric forces onto a detector (D) that produces electrical signals that are recorded and displayed by a data processing system (not shown) as a mass spectrum of the ion fragments (the product-ion spectrum). In alternative embodiments of tandem mass spectrometers, the second quadrupole MS2 can be a quadrupole ion trap (mass dispersion via RF electric forces), an orbitrap (mass dispersion via RF electric forces), a FT ICR cell (mass dispersion via RF electric forces), a time-of-flight analyzer (mass dispersion via static electric forces), or a magnetic sector mass analyzer (mass dispersion via static magnetic forces). In other alternative exemplary configurations of tandem mass spectrometers, the first quadrupole MS1 may be a magnetic sector mass analyzer, and the second quadrupole MS2 may be a quadrupole ion trap, an orbitrap, a time-of-flight analyzer, or a magnetic sector mass analyzer. In still other exemplary configurations, the first quadrupole MS1 may be a time-of-flight mass analyzer, and the second quadrupole MS2 may be a quadrupole ion trap, an orbitrap, a FT ICR cell, a time-of-flight, or a magnetic sector mass analyzer.

Practicable exemplary configurations of EMS ECD cells that can meet in some degree the first and second conditions articulated above in accordance with the present invention are provided. A first such exemplary configuration of an EMS ECD cell 210 in accordance with the present invention, an ion-transmissive emitter, such as a cone-shaped, electron emitter 300, FIGS. 3A, 3C, may be placed between two axially polarized permanent magnets 212, 214 having central apertures/bores 217, 219, FIG. 2A. The magnets 212, 214 may be two axially polarized $Sm_2Co_{17}$ ring-magnets having 25.4 mm diameter, 1.0 mm thickness, and 2.0 mm diameter bore 217, 219 (Chino Magnetism Corp. Ltd., Fairfield, N.J.) to meet the conditions for creating a high degree of overlap between the electron- and ion-volumes in the cell 210. Optional pole pieces 216, 218, such as iron discs, having an outer diameter of 25.4 mm, inner diameter of 3 mm, and 1 mm thickness may be provided on the sides of the magnets 212, 214.

The emitter 300 may comprise tantalum or yttrium (III) oxide coated tungsten or rhenium. The emitter 300 should be ion transmissive when the emitter 300 is disposed along the axis, A, along which the ions, I, travel through the cell 210. In this regard, the emitter 300 may include an aperture 303 created by truncating the cone 302 at the apex to allow ions to pass through the cone 302. Three independent filaments 301 may be attached to the periphery of the cone 302 to heat the cone 302. The filaments may be formed of tantalum, tungsten, and/or rhenium, for example.

Figure 2A:
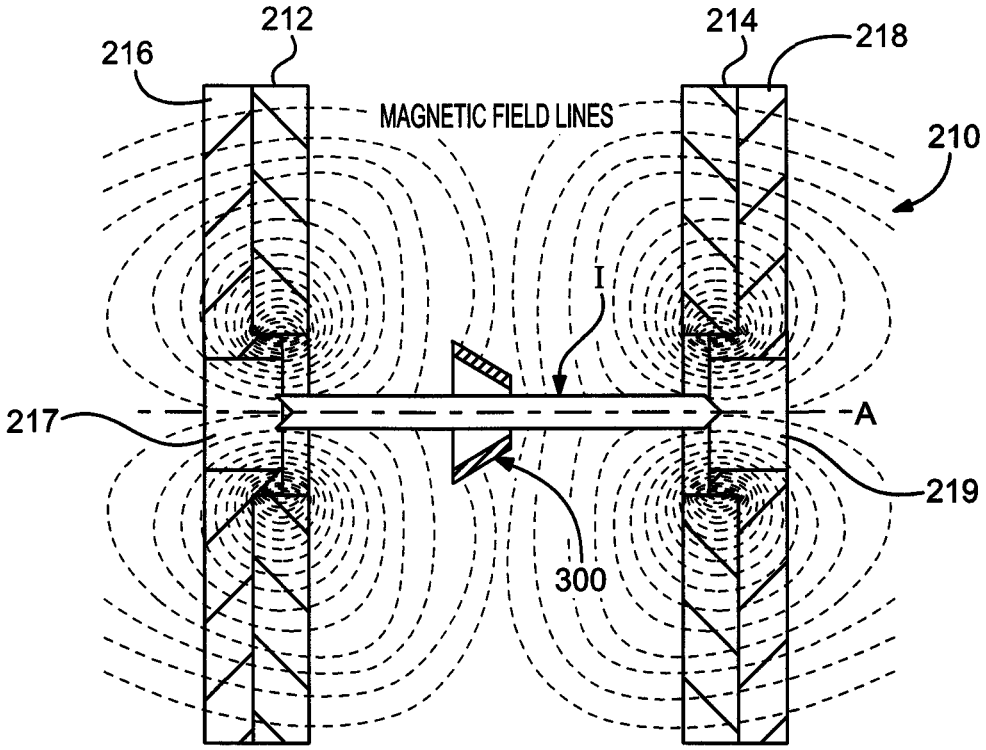
Figure 2B:
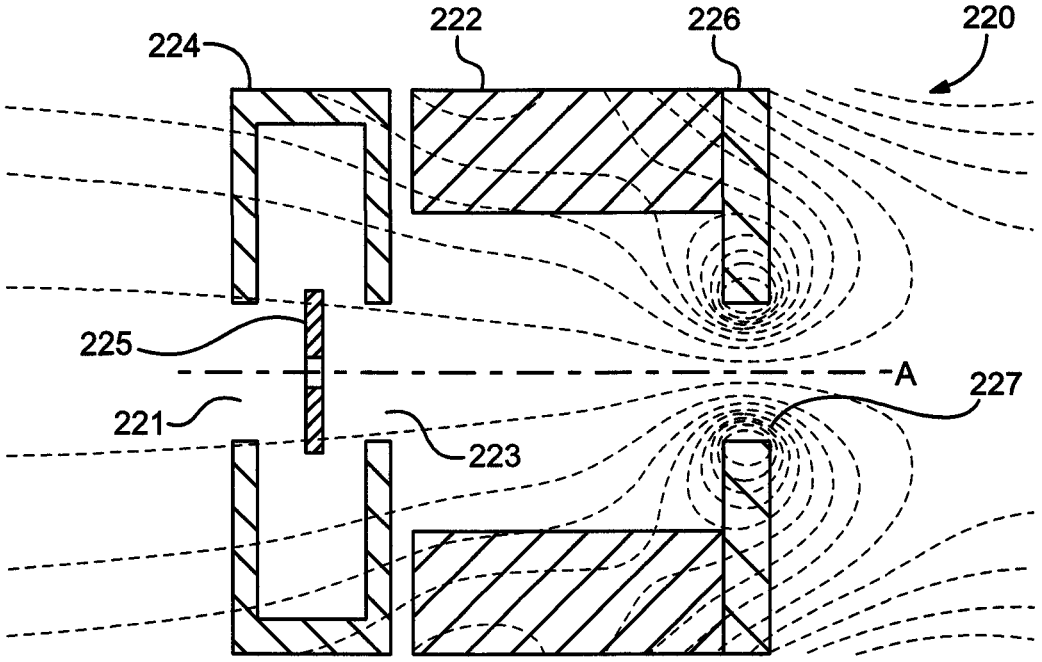

Due to the emitter's cone shape and its placement on the axis, halfway between the magnets 212, 214, the lines of magnetic flux created by the magnets 212, 214 (and, optionally by pole pieces 216, 218) intersect the emitter 300 almost perpendicular to its surface over most of its area, FIG. 2A. Therefore, a relatively large fraction of electrons are emitted nearly perpendicular to the emitter's surface and intersect the lines of magnetic flux density at an angle close to zero at the emitter's surface (Condition 1). In addition, the lines of magnetic flux bend by almost 90° as they approach the axis of the cell 210 so that the lines of magnetic flux become almost parallel to the axis as they approach the magnets 212, 214. Thus, the electrons captured on the lines of magnetic flux density as they leave the emitter 300 follow those lines of flux to where they intersect the ion beam as it passes through the cell 210 near the axis (Condition 2). When used with the same configuration of magnets 212, 214 as shown in FIG. 2B, the (1) cone emitter's very large surface, (2) absence of induced magnetic field, and (3) substantially narrower distribution of emitted electron energies resulted in an ECD efficiency of at least 2%, which is at the threshold of analytical utility. While the cone emitter of 300 FIG. 2A is illustrated as a right circular cone, other shapes may be used such as a paraboloid or hyperboloid of revolution. In addition, the emitter may include two such shaped surfaces, such as two cones, FIG. 3B.

Figure 4A:
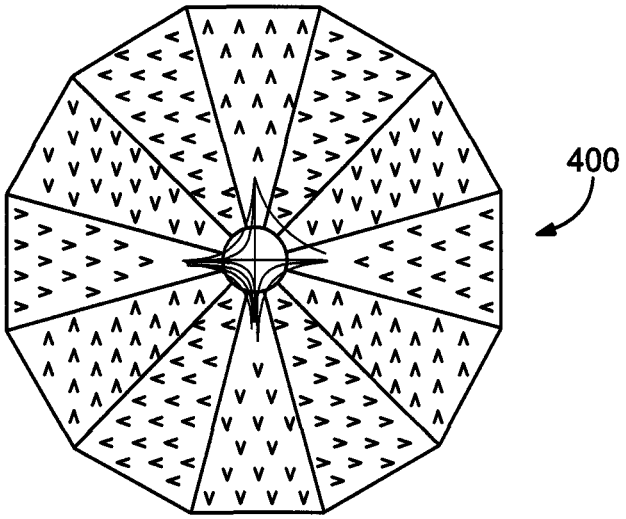
FIGS. 4A, 4B schematically illustrate a simulation of the motion of electrons injected into a region between two, 12-segment, quadrupolar Halbach lenses, with views transverse and parallel to the optical axis, respectively.
Figure 4B:
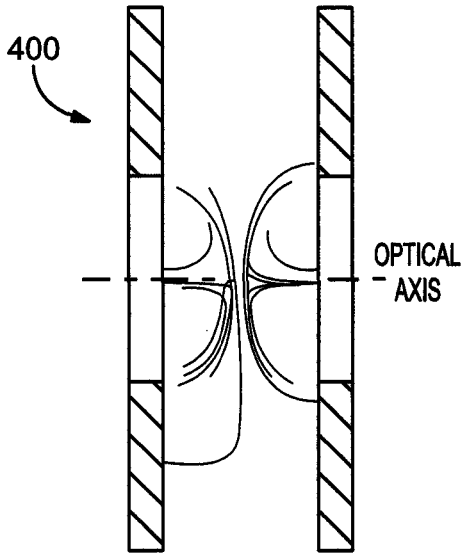

Optionally, the magnets 212, 214, may be provided in the form of a Halbach lens 400, such as (1) two Halbach magnets configured to produce the same multipolar field, (2) two Halbach magnets configured to produce different multipolar fields, (3) a Halbach magnet configured to produce a multipolar field and an axially polarized disc magnet, or (4) two Halbach multiplets (e.g., doublet, triplet, or higher order multiplet), FIG. 4B. The electron source could possibly (but not exclusively) be an ion-transmissive emitter 225, such as a disc electron emitter. The Halbach magnets could be configured from any possible number of segments that produce the desired multipolar field. The transverse axes of two Halbach magnets could be aligned with each other or rotated by any arbitrary angle about their respective axes of symmetry with respect to each other. Similarly, the transverse axes of two Halbach multiplets could be aligned with each other or rotated by any arbitrary angle about their respective axes of symmetry with respect to each other. Halbach multiplets composed of three or more lenses could be symmetric or asymmetric arrangements of those lenses. Computer simulations, indicate that the transverse magnetic field produced by a configuration composed of two quadrupolar Halbach lenses with aligned polarization axes should concentrate a very large number of electrons around the optical axis where they can react with the ion beam passing through the cell, FIGS. 4A, 4B.

A second example of a practicable configuration of an EMS ECD cell 220 in accordance with the present invention may include an ion-transmissive emitter 225, such as a disc emitter, located in a region of weak magnetic flux density produced by an electromagnet 222 coupled to a strong, axially polarized, permanent magnet 226 having a central aperture 227, FIG. 2B. Such an exemplary configuration can meet the conditions for creating a high degree of overlap between the electron- and ion-volumes in the cell 220 by guiding electrons emitted from the emitter 225 through the electromagnet 222. The emitter 225 may be supported by a thermally insulating holder 224 having centrally located apertures 221, 223.

Figure 5A:
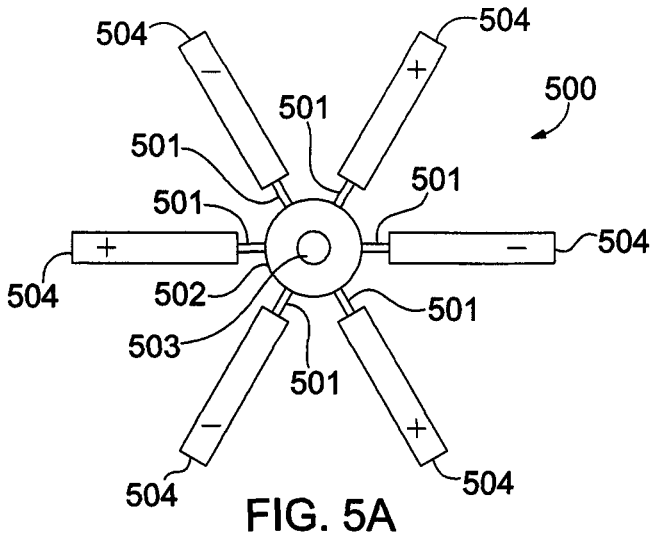
FIGS. 5A, 5B schematically illustrate front and back views, respectively, of an exemplary, flat, tantalum disc-emitter with six wire legs designed and built in accordance with the present invention, where each leg is connected to a relatively larger post, the latter for connection to the positive (+) and negative (−) terminals of a power supply to provide heating current through the emitter's six segments.
Figure 5B:
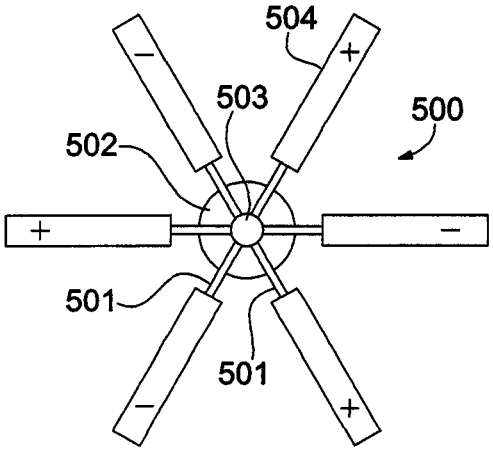

The emitter 225 may include a flat filament 502 (with central hole 503) of materials such as tantalum, tungsten, and/or rhenium, for example, FIG. 5A, 5B. A number, N, of electrically conductive wires 501, N=6, for example, may be electrically connected to the filament 502 at regular intervals to provide N current paths into and out of the filament 502, FIG. 5B. In particular, adjacent pairs of wires 501 may be connected to respective positive and negative power supply terminals to permit a current to flow through the segments of the filament 502 to which the wires 501 are attached. To facilitate connection to the power supply, mounting posts 504 may optionally be provided at the ends of the wires 501.

In the configuration of FIG. 2B, lines of weak magnetic flux produced by the electromagnet 222 gradually slope toward the axis, A, until they reach the strong permanent magnet 226 where they are compressed into a small volume about the axis through which the ion beam passes. Electrons emitted from the filament's flat surface intersect the lines of magnetic flux density at an angle close to zero (Condition 1) and follow the lines of flux into the core of the permanent magnet 226 where they can react with the ions as they pass through the cell 220 (Condition 2). While the emitter 225 has been illustrated as a disc, other shapes of emitter, such as a cone 300, may also be used in the place of the emitter 225 of cell 220 as long as Conditions 1 and 2 are satisfied.

Figure 3A:
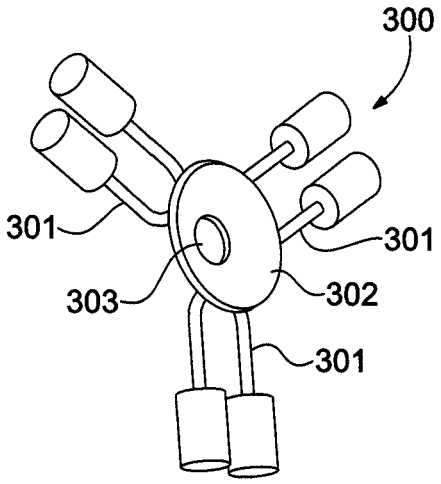
FIG. 3A schematically illustrates an exemplary single-cone emitter in accordance with the present invention.
Figure 3B:
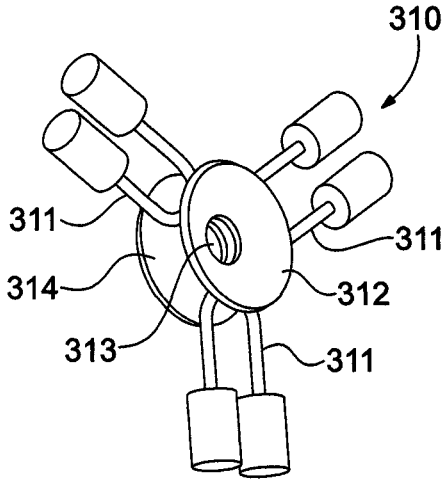
FIG. 3B schematically illustrates an exemplary double-cone emitter in accordance with the present invention.

Some emitters require external heating elements like the tantalum wires 301 of FIG. 3A; in order to raise the temperature of the emitter's surface to that at which electron emission occurs, these external filaments 301 must be heated by an electric current to an even higher temperature. Taking the emitter 300 of FIG. 2A for example, if the emitter 300 is massive, the power required to accomplish this task can become prohibitive and the radiation from the large emitter 300 can heat the permanent magnets 212, 214 past their Curie point, which will eventually demagnetize them, and melt nearby plastic and even metal parts used for insulation and mechanical support. This problem can be mitigated to some degree by reducing the thickness of the emitter 300 and coating it with yttrium (III) oxide ($Y_2O_3$) to lower the temperature for electron emission.

Experiment 1

Figure 3C:
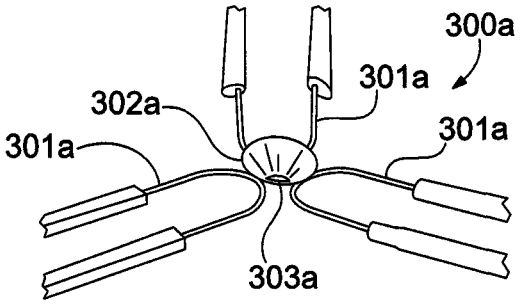
FIG. 3C illustrates a disc emitter of the type shown in FIG. 3A, as fabricated, in accordance with the present invention.
Figure 7:
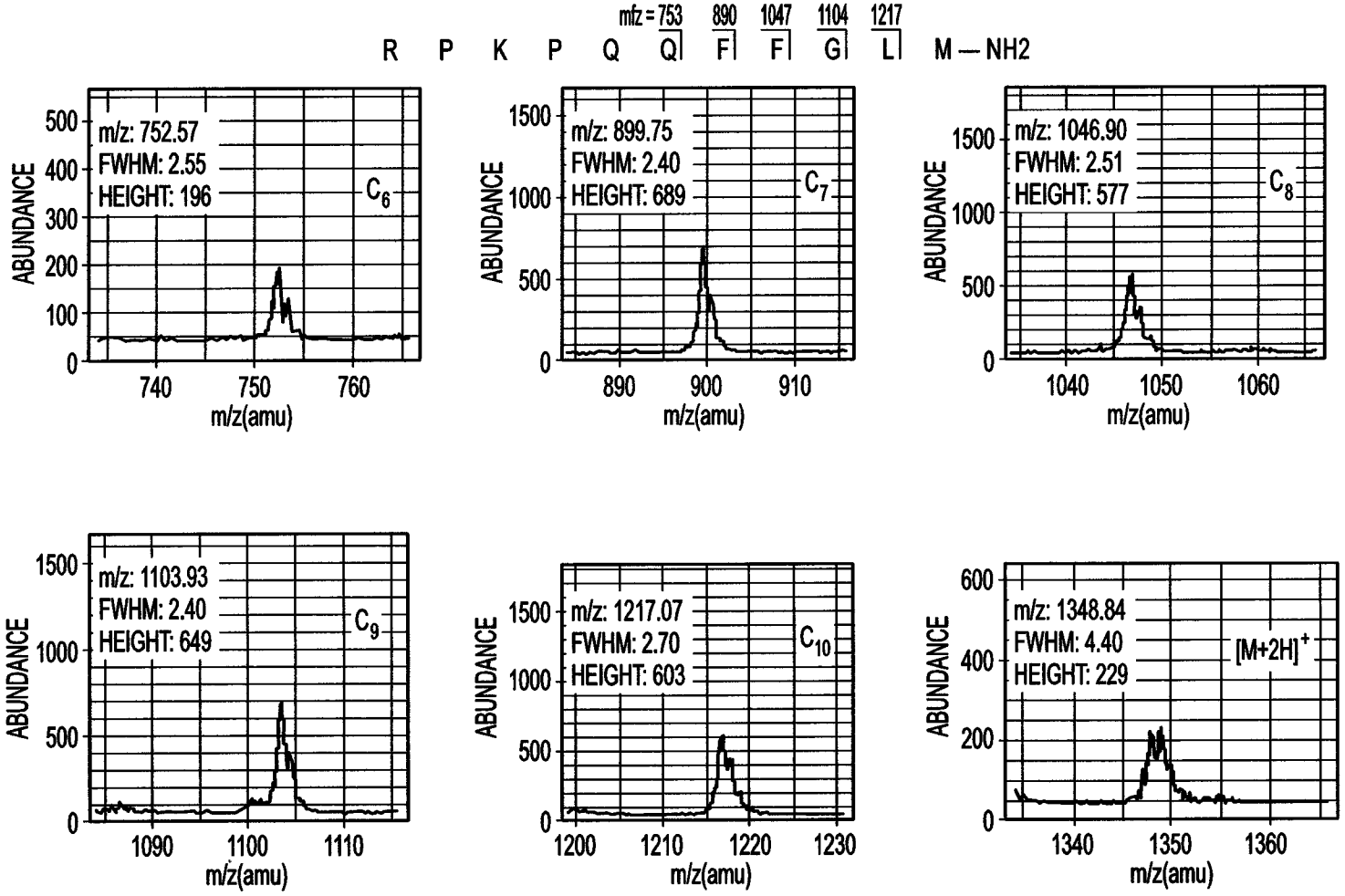
FIG. 7 illustrates ECD product ions of doubly protonated substance P (m/z=674) in methanol infused via syringe at a rate of 400 ng/min, profiles each from accumulation of 128 scans, where the total abundance of the fragments is about 3000 counts, with a precursor ion abundance of ~150,000 counts, the fragment count corresponds to at least 2% ECD efficiency.

A triple quadrupole (Q-q-Q) Finnigan TSQ 700 mass spectrometer was converted to a Q-ECD-Q instrument (cf. FIG. 1) having a tantalum cone 302*a*, FIG. 3C, located concentric with the cell's axis at the ion-entrance, which served as the source of electrons. Cones 302*a* with two different apex angles were manufactured, 45° and 60°. For the 45° cone, the diameter at the base was 5 mm and the diameter of the hole 303*a* was 3 mm; for the 60° cone, the diameter at the base was 3 mm and the diameter of the hole 303*a* was 1 mm. Three pairs of tantalum heating wires 301*a* were attached to the external side of the cone 302*a*, and the emitter 300*a* was used as the emitter 225 in the cell 220 of FIG. 2B, and was fixed in a molybdenum holder 224 with an entrance aperture 221 and exit aperture 223 for passage of ions and electrons. The cell 220 comprised an electromagnet 222, which contained copper wire of 1.2 mm diameter spooled on a titanium bobbin of 70 mm outer diameter, 6.0 mm inner diameter, and 15 mm width, and an axially polarized $Sm_2Co_{17}$ ring-magnet 226 (Chino Magnetism Corp. Ltd., Fairfield, N.J.) that had a 25.4 mm diameter, 1.0 mm thickness, and 3.0 mm bore 227. Using the cone emitter 300*a* as a source of electrons instead of a ring-shaped, wire filament solved three important problems. First, the greatly increased emitting area of the cone 302*a* over that of the wire filament emitted a much larger number of electrons. Second, the problem of voltage drop through the emitter 300*a* was eliminated; in the case of a ring-shaped, wire filament, this voltage drop could be up to 7 V resulting in an excessively wide electron energy distribution. Third, the problem of the magnetic field induced by the current in the ring-shape wire filament negatively affecting electron emission was totally eliminated. Taken together, the gains resulting from these three improvements increased the ECD efficiency of the EMS cell 220 up to at least 2%, which is at the threshold of analytical utility. For example, FIG. 7 exhibits ECD fragments recorded while injecting 5 μg/mL solution of substance P in methanol at a flow rate of 2 μL/min using the 60° cone-shaped emitter 300*a*.

However using this type of tantalum cone emitter 300*a* imposed a new problem. Thermal radiation from this emitter was prodigious because much more power was required to heat the tantalum cone 302*a* than was required to heat wire filament emitters. This in turn overheated the permanent magnet 226 above its Curie point eventually demagnetizing it and melted anodized aluminum spacers that were used. Using the electromagnet 222 (a solenoid) in the first place solved this overheating problem. Placing the electromagnet 222 between the electron emitter 300*a* and permanent magnet 226 provided sufficient separation to keep the permanent magnet 226 at a working temperature.

Second, the electromagnet 222 could provide continuous magnetic lines from the electron source (emitter 300*a*) to the axis (i.e., ion path). Magnetic lines served as guides for electrons, leading them in direction of the permanent magnet 226 while converging them in the direction of ion axis, A. Thus, it became clear that using an electromagnet 222 in combination with the high power electron emitter 300*a* (producing a lot of heat) was not just a simple substitution for a permanent magnet, but provided additional and sometimes necessary benefits.

Experiment 2

In a second experiment in accordance with the present invention, the cell 220 of FIG. 2B was used with an electron emitter 225 fabricated in the form of a flat disc 502, FIGS. 5A, 5B, and with the electromagnet 222, because the electromagnet 222 can provide a magnetic field with lines perfectly perpendicular to the surface of disc 502 (Condition 1, requirement for the best guiding electrons from emitter to the axis where ions are). Flat disc emitters 500 can be made two to three times thinner than cone-shaped emitters 300 and, thus, require less power and generate correspondingly less heat radiation. The heating current may be provided through the disc emitter 500.

Figure 6A:
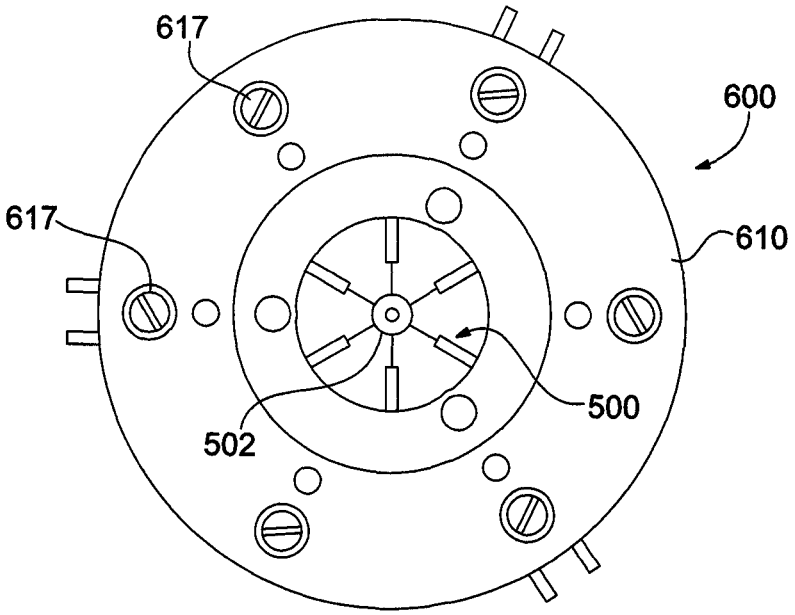
FIG. 6A schematically illustrates a top view of a fabricated emitter assembly comprising the emitter of FIG. 5A disposed within a holder made of ceramic.
Figure 6B:
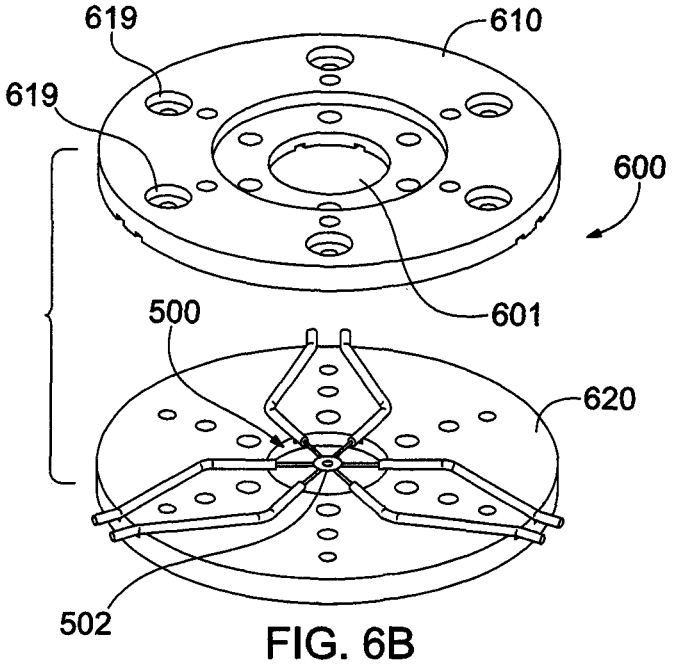
FIG. 6B schematically illustrates an exploded view of the emitter assembly of FIG. 6A showing the top and bottom portions of the holder and how kinks in the current leads are used to prevent the emitter from twisting or sliding once fixed in the holder.

Two exemplary forms of emitters in accordance with the present invention were created that retained the advantages of both a loop filament (viz. small bulk/size, low power consumption, tolerance to low vacuum, and low cost) and an indirectly heated dispenser cathode (viz. large emitting area, no voltage drop through emitter, no induced parasitic magnetic field). One exemplary, fabricated emitter 500 comprised a flat disc filament 502 (3.0 mm OD, 1.0 mm ID and 0.05 mm thickness) made of tantalum and six radially attached wires 501 of 0.25 mm diameter of tantalum, FIGS. 5A, 5B. The body of the emitter 500 was placed in a ceramic holder 600 having a lid 610 and base 620 with a central aperture 601 which were held together by screws 617 through holes 619 in the lid 610, FIGS. 6A, 6B, and was heated in a novel way.

Figure 8A:
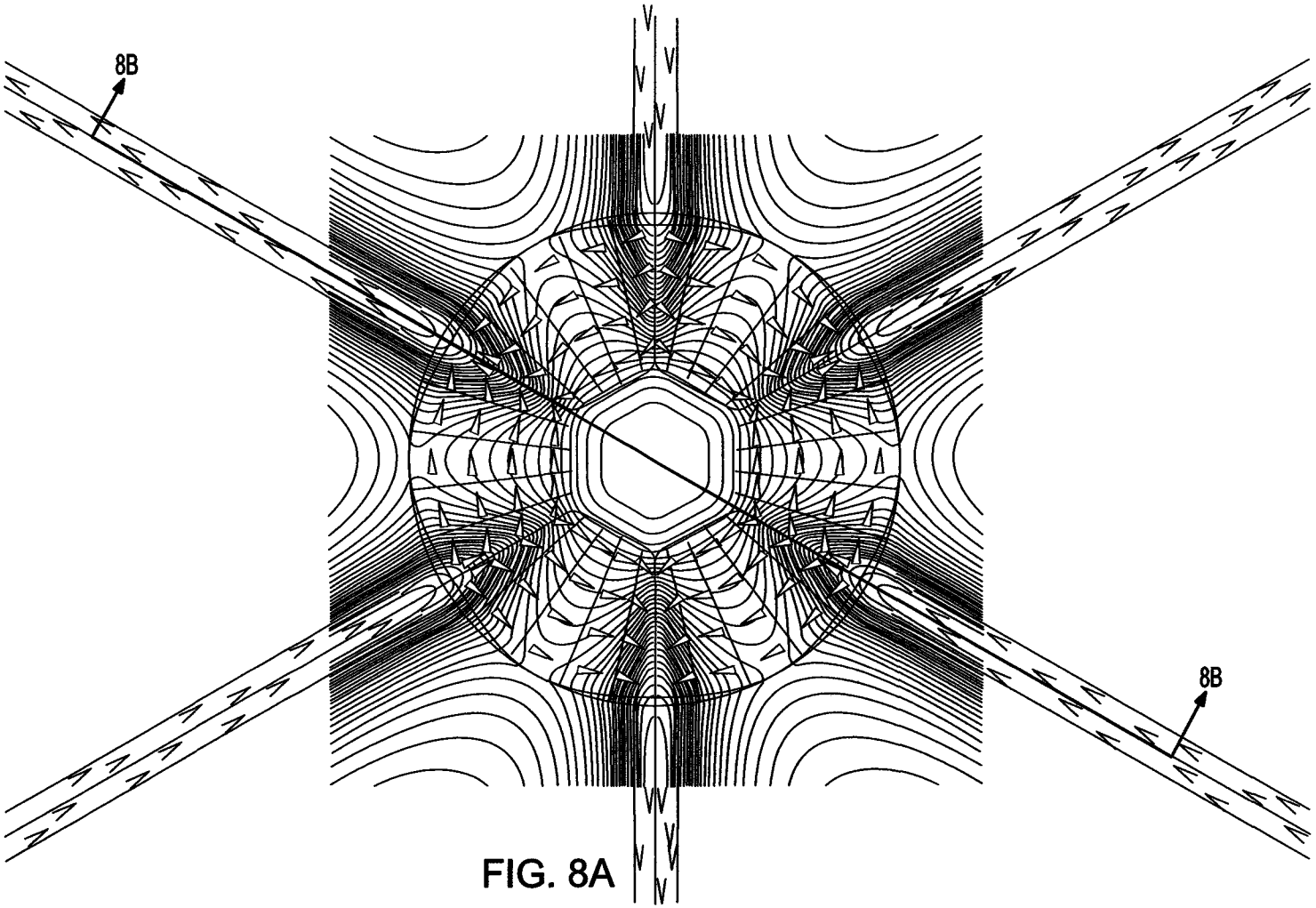
FIG. 8A schematically illustrates contours of magnetic flux density, which were produced by a computer model of the flat disc emitter of FIGS. 5A, 5B with a direct current of 3 A flowing through each of the six leads in the direction indicated by arrows, and illustrating that the magnetic field in the central area of the disc is virtually negligible.
Figure 8B:
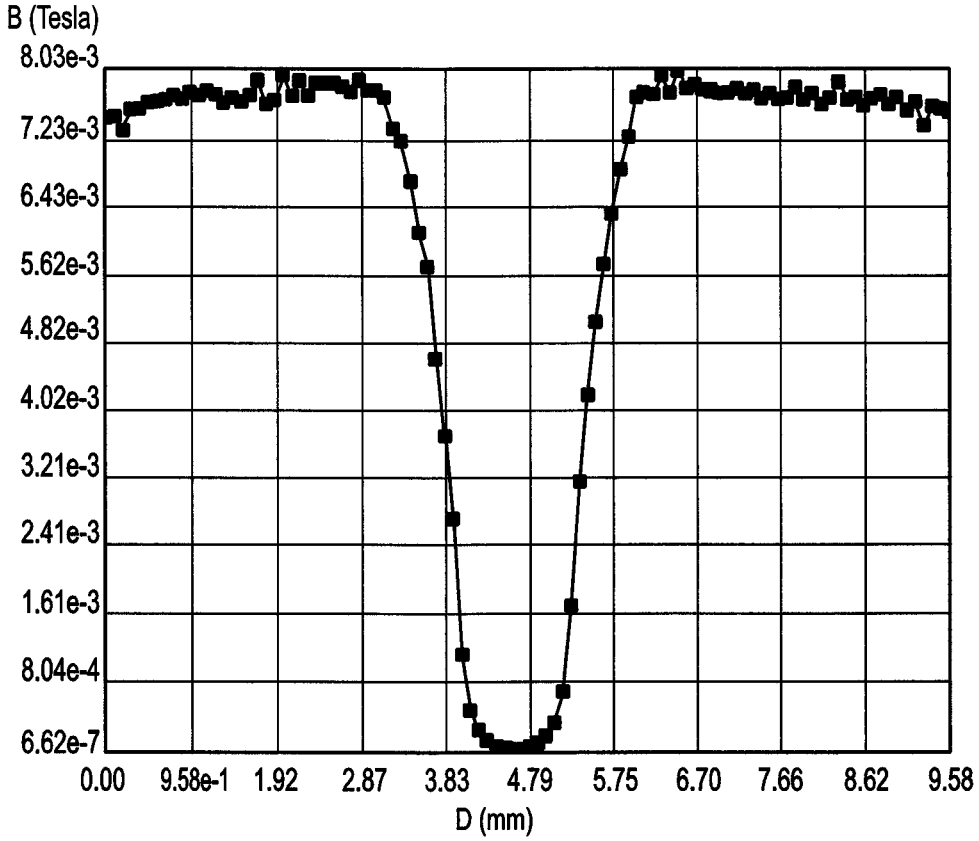
FIG. 8B schematically illustrates the field distribution across the emitter taken along line 8B-8B in FIG. 8A.

The current leads 501 were alternately connected to the positive (+) and negative (−) terminals of a power supply, thus forcing heating current to pass through six wedge-shaped segments of the emitter filament 502, FIG. 8A; most of the current passed through the larger radius sections of the six segments. The voltage drop across these six segments was small. Since the heating current passed in opposite directions, the induced magnetic fields practically cancelled each other. Computer modeling using a software package designed for analysis of electric and magnetic fields (LORENTZ-EM: Integrated Engineering Software, Winnipeg, Manitoba, Canada) clearly showed that the disc emitter 500 induced essentially no parasitic magnetic field near the emitter's aperture 503 where electrons are emitted closest to the ion beam, FIGS. 8A, 8B. As with the cone emitter 300, the operating temperature of the newly created disc emitter 500 could be lowered by coating it with yttrium (III) oxide ($Y_2O_3$). Although six current leads 501 are illustrated, more or fewer could be used. With more leads the disc 502 would effectively be divided into smaller current-carrying segments with a smaller voltage drop through each segment.

Figure 10:
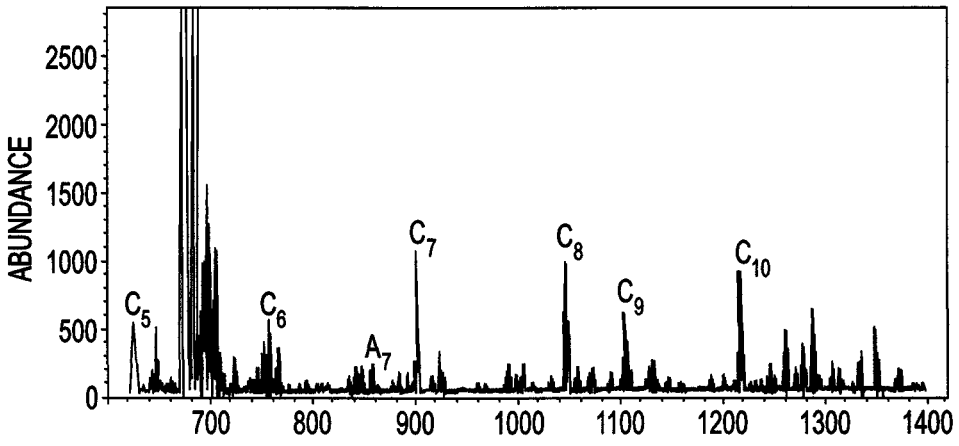
FIG. 10 illustrates an ECD mass spectrum of a solution of substance P in methanol infused via syringe at a rate of 200 ng/min, spectra from 8 scans accumulated, acquisition time<1 second.
Figure 9:
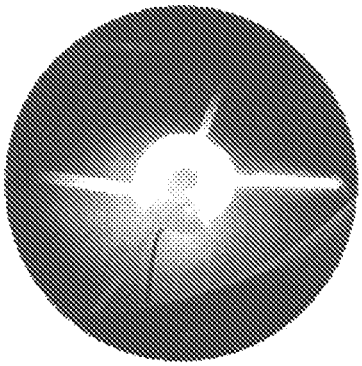
FIG. 9 illustrates a photograph of a tantalum disc emitter of the type of FIG. 5A heated by passing electric currents through four wires of different diameter in an experiment to determine the optimum wire diameter, where the slightly overheated wire on the right side is too thin, the under-heated wires on top and bottom are sucking heat from the disc, and the wire on the left side is close to optimal diameter.
Figure 11:
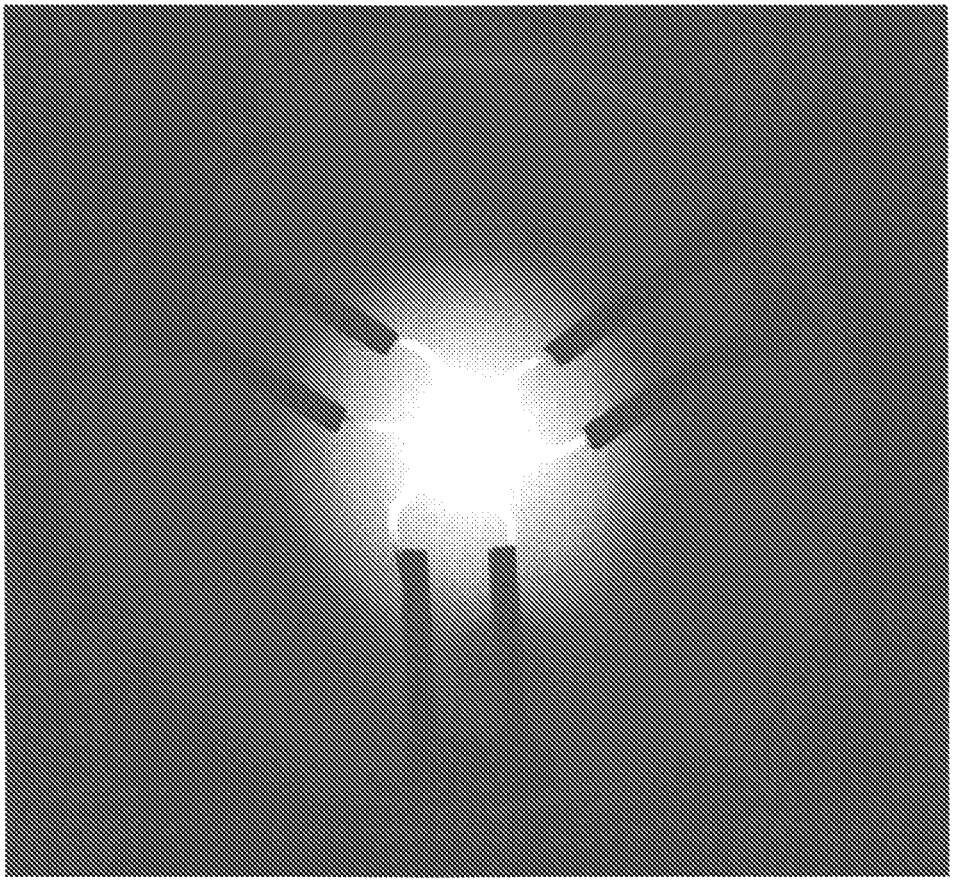
FIG. 11 illustrates a photograph of the flat disc emitter (3.0 mm OD×1.0 mm ID×0.05 mm thick) with heating current used to obtain the spectra of FIG. 10, in which it is visible that the disc is the same temperature as the wires, and is heated uniformly.

The diameter of the lead wires 501 was an important parameter in minimizing the emitter's power consumption. If the wire diameter were too small, the wires 501 would overheat before the emitter surface reached emission temperature; if the wire diameter were too big, the wires 501 would suck heat from the disc 502 and the disc 502 would not heat uniformly, FIG. 9. Wires 501 having the optimal diameter would supply power to the emitter disc 502 without dissipating any themselves through heating. The contributions to the loss of power showed heat distribution over the emitter 500 in one of the experiments for determining a suitable wire diameter, FIG. 11. A suitable diameter may be between 0.03 mm and 0.3 mm. Tests with this new tantalum disc emitter 500 demonstrated that EMS ECD cell efficiency increased substantially over that obtained with wire filaments. At this efficiency, the time required to record an ECD product ion spectrum of analytical quality was less than 1 s, which was compatible with the liquid chromatographic time scale, FIG. 10.

Figure 5C:
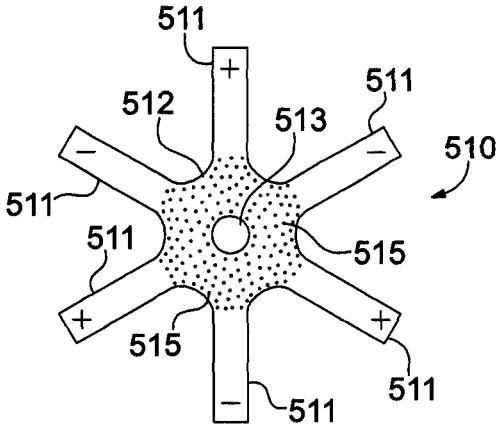
FIG. 5C illustrates a top view of a yttrium (III) oxide coated ($Y_2O_3$), flat disc-emitter, as-fabricated, with six legs cut from a single piece of tantalum in accordance with the present invention.

In a second exemplary configuration of a first form of an emitter in accordance with the present invention, the emitter comprised a flat disc 510 (e.g., 3.0 mm OD, 1.0 mm ID and 0.05 mm thickness) and six radial legs 511 cut (e.g., by electron discharge or laser machining) from a single piece of tantalum foil coated with yttrium (III) oxide 515, FIG. 5C. Wire leads welded to the six legs 511 were used to supply heating current to the emitter 510. In all other respects, this monolithic embodiment of the disc emitter 510 had the same operating characteristics, as those of a circular disc configuration of FIGS. 5A, 5B.

Figure 12:
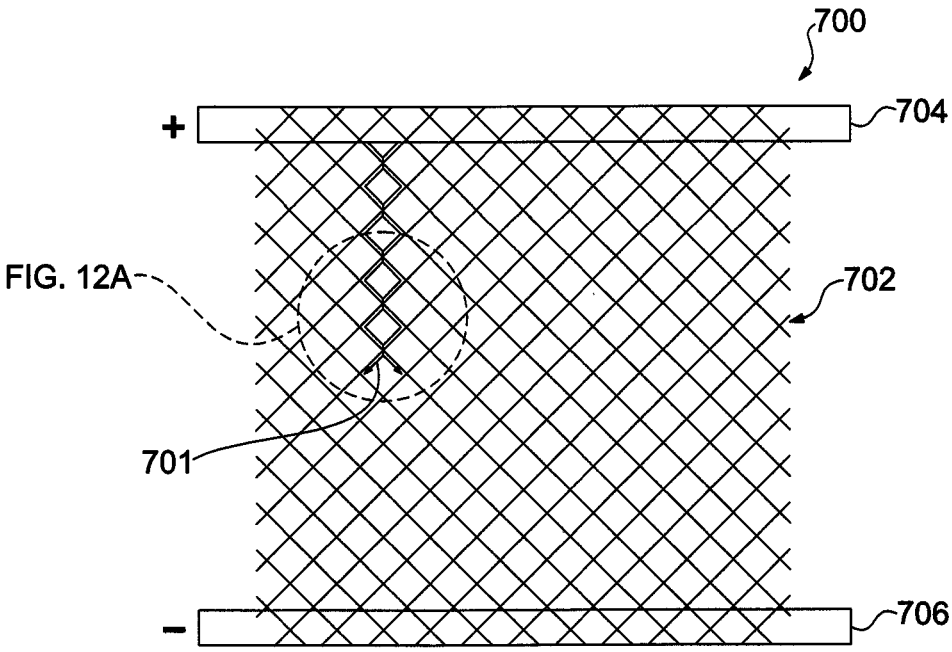
FIGS. 12, 12A schematically illustrate a wire mesh-emitter in accordance with the present invention mounted diagonally between two wires that serve as positive (+) and negative (−) current-leads designed and built, respectively, in accordance with the present invention, with arrows showing the principal directions of current flowing through the mesh.
Figure 12A:
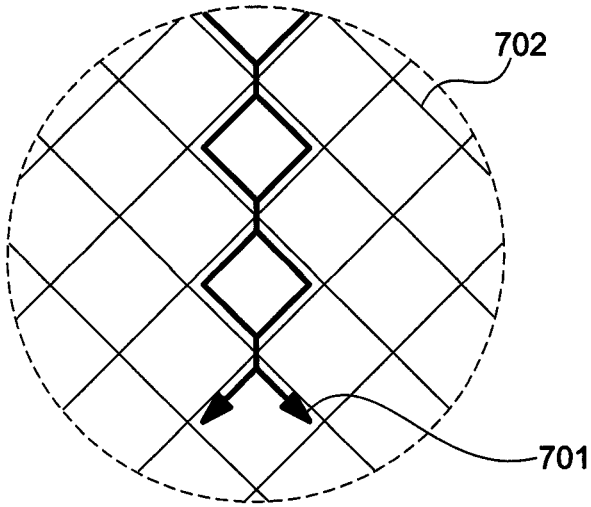
Figure 15A:
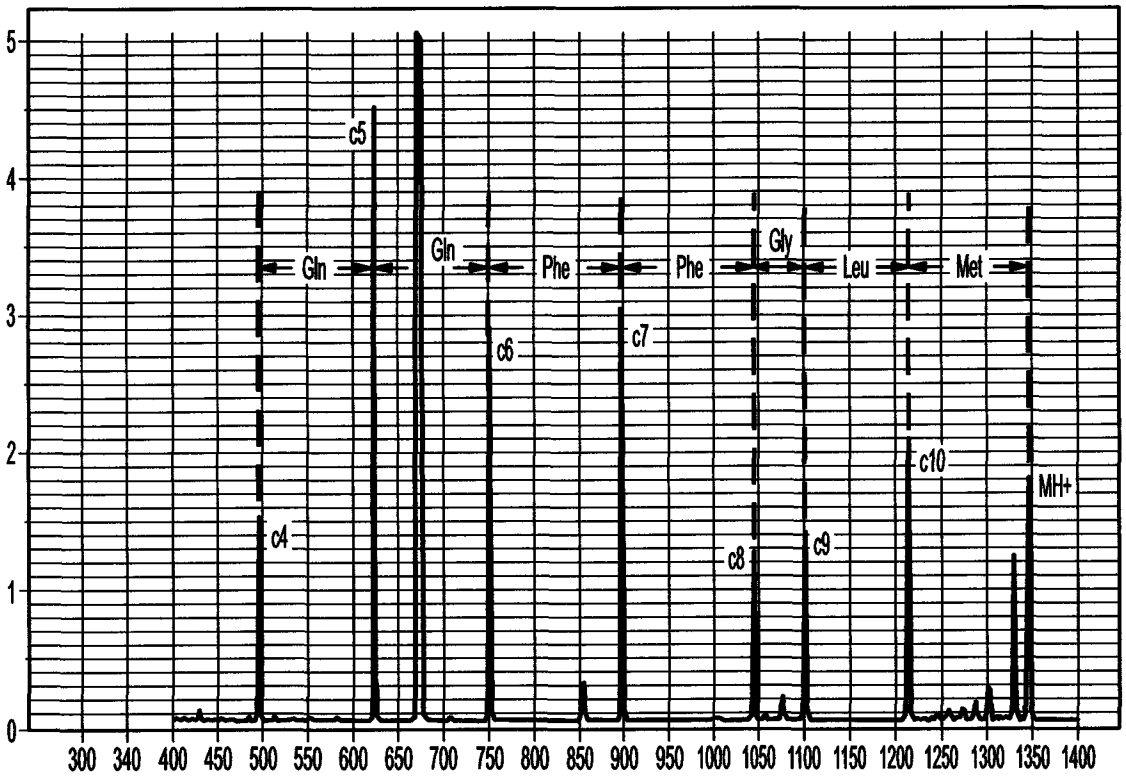
FIG. 15A schematically illustrates an accumulated ECD product ion mass spectrum of substance P (Arg-Pro-Lys-Gln-Gln-Phe-Phe-Gly-Leu-Met) infused in a solution of 50% methanol, 0.05% formic acid (40 μg/mL) into the ESI source of a quadrupole tandem mass spectrometer (FIG. 1) via syringe at a rate of 200 ng/min and dissociated in an EMS ECD cell of FIG. 2B fitted with the mesh-emitter of FIG. 12, with spectra from 29 scans accumulated over an acquisition time on the order of 1 second, and showing an ECD efficiency estimated by dividing the ion-count of the precursor (i.e., doubly protonated substance P) by the sum of the ion counts of the labeled product ions (c4-c10) plus $MH^+$ equals 2.3%.
Figure 15B:
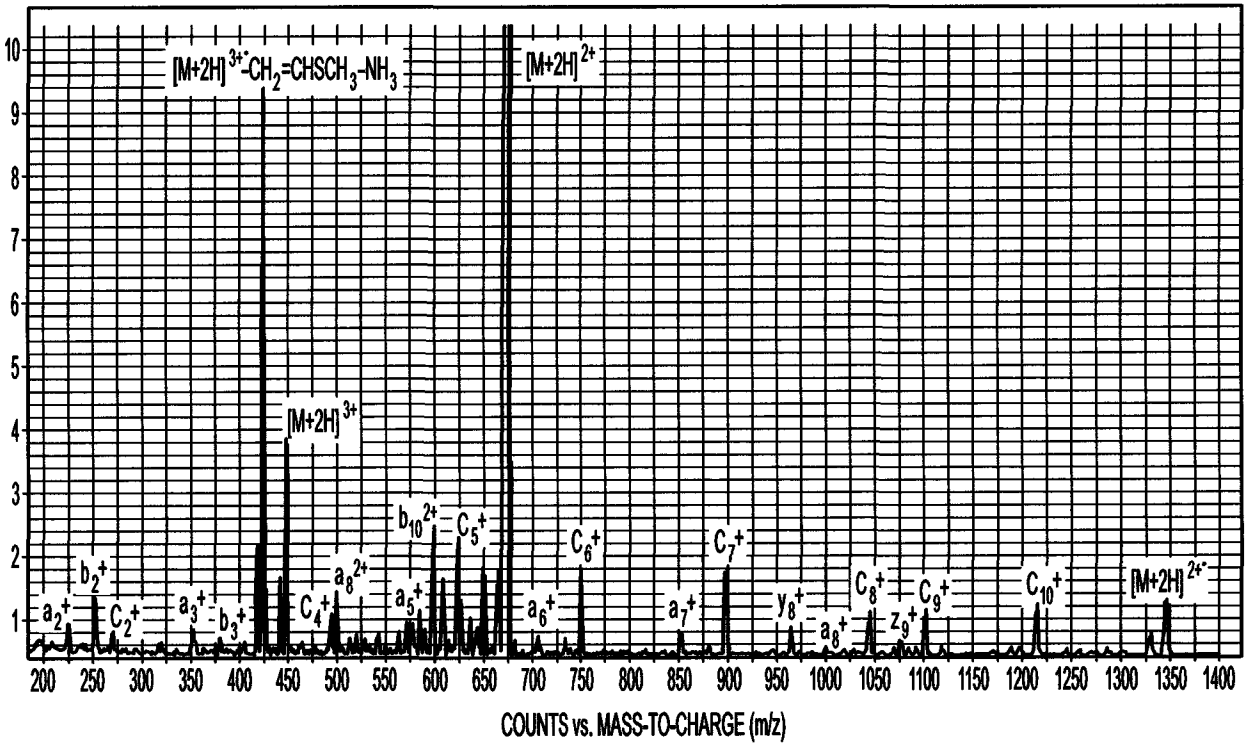
FIG. 15B illustrates an EID spectrum of substance P using the cell of FIG. 2B and emitter of FIG. 12.

Turning away from Experiment 2 and to the aforementioned second form of emitter in accordance with the present invention, a first exemplary configuration of a second form of an emitter 700 includes a mesh 702 of woven wire, for example, tantalum, tungsten, or rhenium, suspended between two wires that serve as current leads 704, 706, FIG. 12. Meshes, which are characterized in terms of mesh number (number of lines of mesh per inch) with different wire diameters and pore sizes, have high specific surface areas, i.e., they have more emitting surface than flat sheets of metal of the same dimensions. A current 701 passes through all the mesh wires (arrows, FIGS. 12, 12A) resulting in electron emission from each wire of the mesh 702. Placing such an emitter 700 into a parallel magnetic field (i.e., a field produced by a solenoid, two permanent magnets facing each other with opposite polarity, or a combination of electromagnets and permanent magnets) will allow a very large fraction of the emitted electrons to intersect the lines of magnetic flux density at an angle close to zero (Condition 1). For example the emitter 700 may be used as the emitter 300 or the emitter 225 in the cells 210, 220 of FIGS. 2A, 2B, respectively. Inasmuch as ions pass through the mesh 702 where electrons are being emitted, the electron density throughout the entire ion beam is uniform, and large numbers of the electrons can be captured by the ions as they pass through the cell (Condition 2). ECD and EID product ion mass spectra of exceptionally high analytical quality, FIGS. 15A, 15B, were obtained when a single tungsten mesh emitter 700 was used in place of the disc emitter 225 of the cell 220 of FIG. 2B.

Figure 13A:
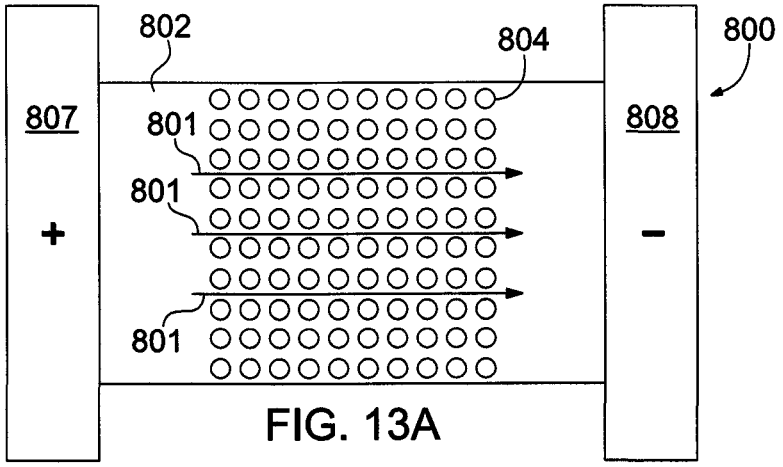
FIG. 13A schematically illustrates an exemplary configuration of a strip-emitter in accordance with the present invention with equally sized holes arranged on a uniform rectangular grid pattern in a thin strip of metal, such as tantalum, tungsten, or rhenium.
Figure 13B:
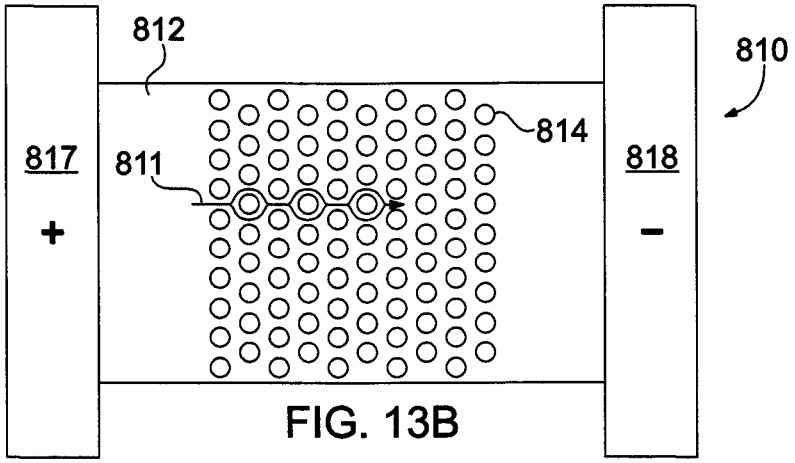
FIG. 13B schematically illustrates an exemplary configuration of a strip-emitter in accordance with the present invention with equally sized holes arranged on two staggered, uniform rectangular grid patterns in a thin strip of metal, such as tantalum, tungsten, or rhenium.
Figure 13C:
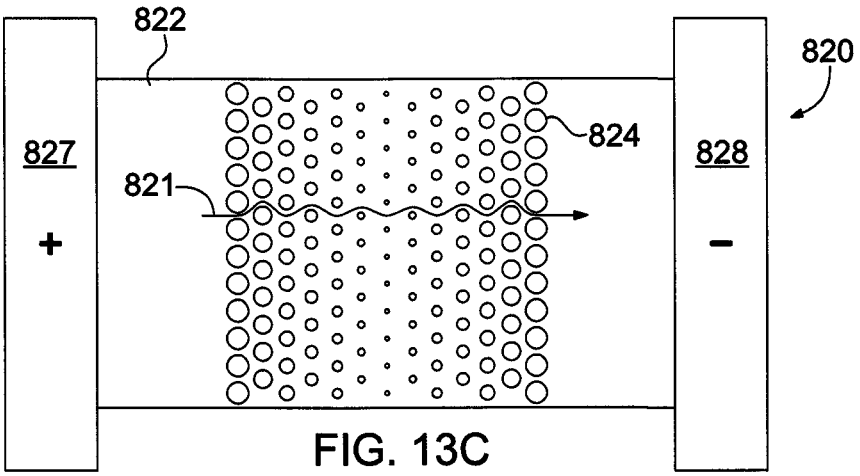
FIG. 13C schematically illustrates an exemplary configuration of a strip-emitter designed and built, respectively, in accordance with the present invention with equally sized holes arranged on two uniform rectangular grids overlaid on a thin strip of metal, such as tantalum, tungsten, or rhenium.

In a second exemplary configuration of the second form of an emitter in accordance with the present invention, the emitter 800, 810, 820 may comprise a strip of metal from about 0.01 mm to 0.2 mm 802, 812, 822, for example, tantalum, tungsten, or rhenium (with or without a yttrium (III) oxide coating), perforated with tiny holes 804, 814, 824 which may range in diameter from 1 micron to 200 microns, for example. The holes may be arranged in a rectangular grid pattern and suspended between two wires that serve as current leads, FIGS. 13A-13C. The current 801, 811, 821, may travel between the two wires 807, 808, 817, 818, 827, 828 along the emitter 800, 810, 820. The holes 804, 814 may be of the same size, or the holes 824 may be of differing size and shape, with relatively smaller holes optionally more centrally located on the emitter 820. The holes may be circular, hexagonal, or have any other noncircular shape. In all other respects, this strip configuration of the emitter 800, 810, 820 may have the same or similar operating characteristics as those of the mesh configuration 700, and may be used as the emitter 300 or the emitter 225 in the cells 210, 220 of FIGS. 2A, 2B, respectively.

Figure 13D:
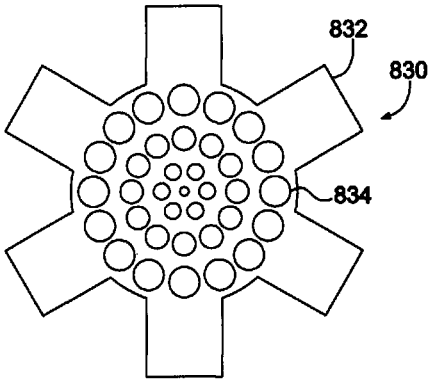
FIG. 13D schematically illustrates an exemplary configuration of a disc-emitter in accordance with the present invention with variously sized holes centrally located in a radial pattern in a thin sheet of metal, such as tantalum, tungsten, or rhenium, with six legs for connection alternately to the positive (+) and negative (−) terminals of a power supply to provide a heating current through the emitter's six segments.

In a third exemplary configuration of the second form of an emitter in accordance with the present invention, the emitter 830 may comprise a monolithic six-legged metal disc 832 of, for example, tantalum, tungsten, or rhenium (with or without a yttrium (III) oxide coating), perforated with tiny holes 834 arranged in a radial grid pattern, FIG. 13D. Such an emitter 800 can possess advantages of both the disc emitter (e.g. 500) and mesh emitter (e.g., 700), viz. negligible voltage drop, negligible parasitic magnetic field, large emission area, and homogeneous electron density throughout the entire cross section of the ion beam.

Figure 14:
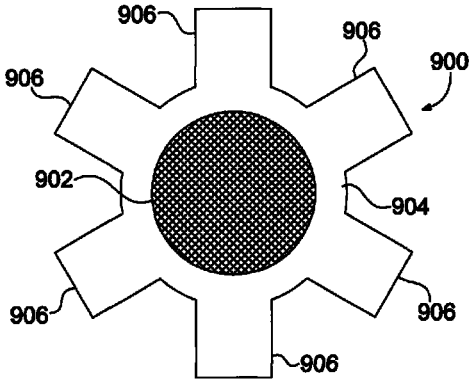
FIG. 14 schematically illustrates an exemplary configuration of a wire mesh-emitter mounted on a ring of, for example, tantalum, tungsten, or rhenium metal, designed and built, respectively, in accordance with the present invention, with six legs for connection alternately to the positive (+) and negative (−) terminals of a power supply to provide a heating current through the ring's six segments.

In a fourth exemplary configuration of the second form of an emitter in accordance with the present invention, an emitter 900 may include a mesh 902 of woven wire (e.g., tantalum, tungsten, or rhenium wire) mounted in the center of a monolithic six-legged ring 904 of a metal sheet, such as, tantalum, tungsten, or rhenium metal, FIG. 14. Although six current leads in the form of six legs 906 integral to the ring 904 are illustrated in this example, separate leads could be wires fastened by, for example, welding to the ring 904. In addition, more or fewer current leads/legs 906 could be used. With more leads/legs 906 the ring 904 would effectively be divided into smaller current-carrying segments with a smaller voltage drop through each segment. Such an emitter 900 can meet both Conditions 1 and 2 for creating a high degree of overlap between the electron- and ion-volumes in an EMS electron-induced dissociation cell, and may be used as the emitter 300 or the emitter 225 in the cells 210, 220 of FIGS. 2A, 2B, respectively. Like emitter 830, this particular exemplary configuration comes close to meeting the requirements of an ideal electron source, viz., it has a large, homogeneous emission area (and a correspondingly high electron yield), negligible voltage drop across the emission area, negligible parasitic magnetic field, and an ability to operating at pressures on the order of $5\times10^{-5}$ Torr.

Figure 16:
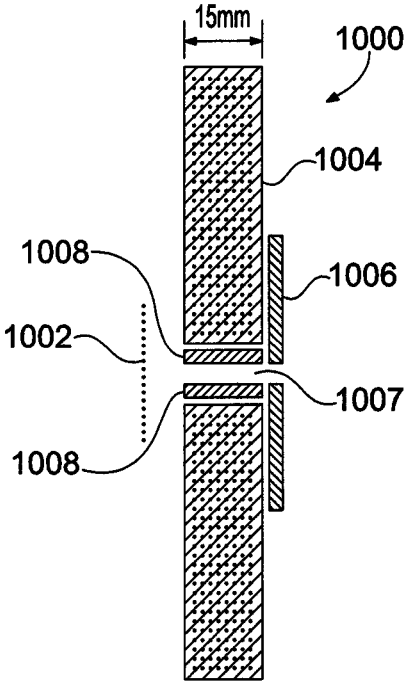
FIG. 16 schematically illustrates a cross-sectional view of an exemplary configuration of an EMS electron-induced dissociation cell in accordance with the present invention comprising a mesh emitter, electromagnet, and optional permanent magnet disposed in an arrangement similar to FIG. 2B but having four small rods with length of 5-10 mm placed inside the electromagnet bore.
Figure 17A:
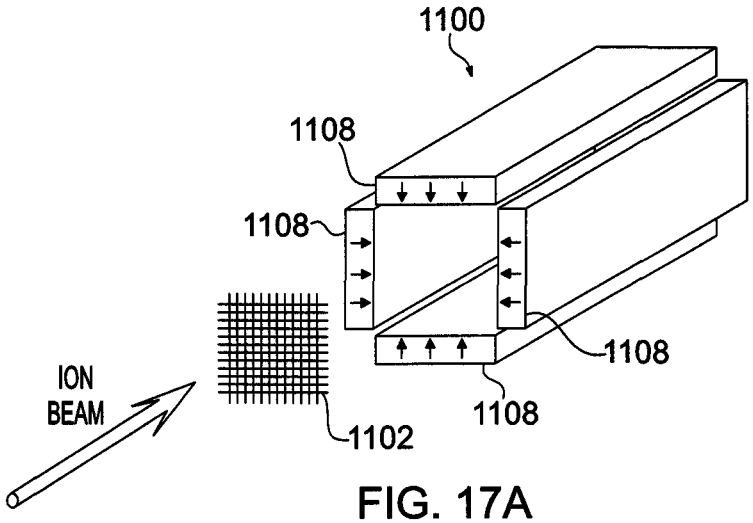
FIGS. 17A, 17B schematically illustrate isometric views of exemplary configurations of EMS electron-induced dissociation cells in accordance with the present invention comprising a mesh emitter and a quadrupole of rectangular, permanent-magnet electrodes having the same polarity proximate the axis (ion path), FIG. 17A, and having the opposite polarities alternately proximate the axis, FIG. 17B.
Figure 17B:
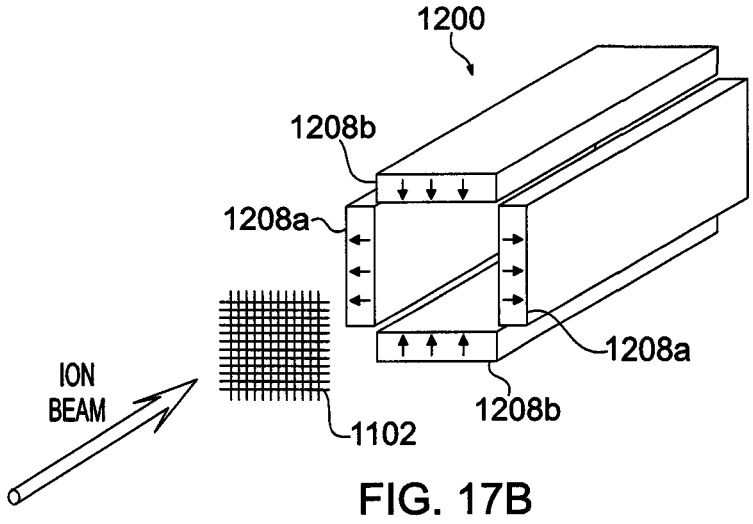

In a further aspect, the present invention provides additional cell configurations 1000, 1100, 1200, FIGS. 16, 17A, 17B, suitable for use with emitters of the present invention, such as the mesh emitters 700, 800, 810, 820, 830, 900 of FIGS. 12-14. With regard to FIG. 16, the exemplary cell 1000 may include a mesh emitter 1002, an electromagnet 1004, and an optional permanent magnet 1006, similar in certain respects to the cell of FIG. 2B but with four tiny rods 1008 of titanium or stainless steel, for example with a length of 5-10 mm placed inside the bore 1007 of the electromagnet 1004. A DC voltage the same as DC voltage on electromagnet 1004 along with an AC voltage with amplitude of order 1-3 Volts may be provided on the rods 1008. The rods 1008 should not have any effect on ion trajectories, but the low amplitude AC voltage should be sufficiently large to bounce the electrons around, guiding them along the magnetic lines created by the electromagnet, thus bringing more electrons emitted by the emitter 1002 in proximity with the ions, not only in the bore of permanent magnet, but also along the path length inside electromagnet 1004 (solenoid).

The exemplary configuration of FIG. 16 can be simplified. For instance, instead of placing rods 1008 with low amplitude RF inside of the electromagnet 1004, the rods 1008 may be made from a magnetic material (i.e., may be permanent magnets themselves), which can eliminate the need for any kind of magnet (electromagnet 1004 or permanent magnet 1006) around rods 1008, FIGS. 17A, 17B. In a particular example, a cell 1100 in accordance with the present invention may include mesh emitter 1102 and quadrupole of rectangular electrodes 1108 made of permanent magnets. (The electrodes 1108 can be of different shapes, including, for example, round and hyperbolic, most common in multipole design.) In this particular exemplary configuration, the electrodes 1108 may be oriented with all having the same magnetic polarity directed toward the axis (ion path), FIG. 17A. Alternatively, the electrodes 1108 can be magnetized and placed relative to each other in many ways. For instance, in the cell 1200 a first opposing pair of magnet electrodes 1208*b* has the magnetic polarity directed towards the axis, and a second pair of magnet electrodes 1208*a* has the magnetic polarity directed away from the axis.

The present invention makes it possible to introduce an EMS electron-induced dissociation cell into any existing type of quadrupole or quadrupole/time-of-flight tandem mass spectrometer and to perform ECD, EIEIO, EID, and EDD at an efficiency comparable to or greater than presently possible in an FT ICR mass spectrometer, the only competing approach for those forms of electron-induced dissociation that is currently available commercially.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. For example, any device of the sort disclosed herein, such as those intended expressly for carrying out electron-induced dissociation reactions, by whatever name they might be given, in any type of mass spectrometer, but especially in a tandem mass spectrometer, are contemplated by the present invention. Additionally, though exemplary configurations have been described as containing tantalum, rhenium, tungsten, any refractory materials, or combinations thereof (e.g., alloys) could also be used. Further, discs are illustrated as having a central hole for ions to go through, but in certain applications a flat disc electron emitter without a central hole may be suitable. Heating by electrical current going through segments will work the same for such emitters without a hole and will keep all advantages of discs but will require much less power for heating. It should therefore be understood that this invention is not limited to the particular embodiments described herein, but is intended to include all changes and modifications that are within the scope and spirit of the invention as set forth in the claims.

Throughout this disclosure reference has been made to various patent and non-patent literature, each of which is incorporated herein by reference in its entirety.

What is claimed is:

1. An electromagnetostatic electron-induced dissociation cell, comprising:

at least one magnet having an opening disposed therein and having a longitudinal axis extending through the opening, the magnet having magnetic flux lines associated therewith; and an electron emitter having an electron emissive surface comprising a sheet, the emitter disposed about the axis at a location relative to the magnet where the electron emissive surface is substantially perpendicular to the magnetic flux lines at the electron emissive surface.

2. The electromagnetostatic electron-induced dissociation cell according to claim 1, wherein the at least one magnet comprises a first and a second magnet each having an opening disposed therein, the first and second magnets disposed along a common longitudinal axis extending through the openings.

3. The electromagnetostatic electron-induced dissociation cell according to claim 2, wherein the emitter is disposed between the first and second magnets.

4. The electromagnetostatic electron-induced dissociation cell according to claim 2, wherein the first magnet is disposed between the emitter and the second magnet.

5. The electromagnetostatic electron-induced dissociation cell according to claim 2, wherein the first and second magnets are disposed in contact with one another.

6. The electromagnetostatic electron-induced dissociation cell according to claim 1, wherein the electron emissive surface is disposed at a non-zero angle relative to the axis.

7. The electromagnetostatic electron-induced dissociation cell according claim 1, comprising a plurality of rods disposed in the opening of the at least one magnet and comprising an AC source in electrical communication with the plurality of rods.

8. The electromagnetostatic electron-induced dissociation cell according to claim 1, wherein the emitter comprises an opening disposed therein at a location on the axis to permit the transmission of ions therethrough.

9. The electromagnetostatic electron-induced dissociation cell according to claim 1, wherein the electron emissive surface comprises a flat circular disc.

10. The electromagnetostatic electron-induced dissociation cell according to claim 1, wherein the electron emissive surface comprises a cone-shape.

11. The electromagnetostatic electron-induced dissociation cell according to claim 1, wherein the electron emissive surface comprises a mesh.

12. The electromagnetostatic electron-induced dissociation cell according claim 1, wherein the emitter comprises a sheet having a plurality of holes disposed therein.

13. The electromagnetostatic electron-induced dissociation cell according to claim 1, wherein the electron emissive surface comprises a mesh of electron emissive wires.

14. The electromagnetostatic electron-induced dissociation cell according to claim 1, wherein the electron emissive surface comprises a material that emits electrons in response to a rise in temperature due to an electrical current passing through the material.

15. The electromagnetostatic electron-induced dissociation cell according to claim 14, comprising a plurality of conductive leads electrically connected to the electron emissive surface and a power supply electrically connected to the leads, wherein an adjacent pair of the leads are connected to respective positive and negative power supply terminals.

16. The electromagnetostatic electron-induced dissociation cell according to claim 1, comprising a heating element in thermal communication with the emitter to indirectly heat the emissive surface.

17. The electromagnetostatic electron-induced dissociation cell according claim 1, wherein the magnet is an electromagnet or a permanent magnet.

18. The electromagnetostatic electron-induced dissociation cell according to claim 1, wherein the electron emissive surface is perpendicular to the axis.

19. A mass spectrometer comprising the electromagnetostatic electron-induced dissociation cell according to claim 1.

20. An electromagnetostatic electron-induced dissociation cell, comprising:

a plurality of magnets disposed proximate one another defining a cavity therebetween having a longitudinal axis, the magnets having magnetic flux lines associated therewith;

an AC source in electrical communication with the plurality of magnets; and an electron emitter having an electron emissive surface, the emitter disposed about the axis at a location relative to the magnets where the electron emissive surface is substantially perpendicular to the magnetic flux lines at the electron emissive surface.

* * * * *